United States Patent [19]

Oliver

[11] 4,148,455

[45] Apr. 10, 1979

[54] STANDS FOR TUBULAR ARTICLES

[75] Inventor: Robert J. Oliver, Adelaide, Australia

[73] Assignee: Zimm-Zamm Aktiengesellschaft, Zug, Switzerland

[21] Appl. No.: 814,872

[22] Filed: Jul. 12, 1977

[51] Int. Cl.[2] ..... F16M 13/00

[52] U.S. Cl. ..... 248/524; 248/158

[58] Field of Search ..... 248/524, 523, 158, 519, 248/418, 364, 529, 539, 346; 211/205; 108/150

[56] References Cited

U.S. PATENT DOCUMENTS

| | | | |
|---|---|---|---|
| 497,999 | 5/1893 | Windus | 248/524 X |
| 541,951 | 7/1895 | Slyder | 248/539 |
| 1,666,392 | 4/1928 | Masury | 248/418 |
| 1,805,095 | 5/1931 | Horni | 248/523 X |
| 1,873,693 | 8/1932 | Whitfield | 248/524 |
| 2,312,030 | 2/1943 | Cramer | 248/418 X |
| 2,400,235 | 5/1946 | Johnson | 248/519 X |
| 2,613,899 | 10/1952 | Wagner | 248/346 X |
| 3,184,195 | 5/1965 | Wahl et al. | 248/158 |
| 3,229,948 | 1/1966 | King | 248/346 |
| 3,363,600 | 1/1968 | Gary | 248/539 X |
| 3,515,432 | 6/1970 | Sporman | 248/418 X |
| 3,742,870 | 7/1973 | Gusdorf | 108/150 |

FOREIGN PATENT DOCUMENTS

| | | | |
|---|---|---|---|
| 236066 | 7/1925 | United Kingdom | 248/523 |

*Primary Examiner*—Francis K. Zugel
*Attorney, Agent, or Firm*—Young & Thompson

[57] ABSTRACT

The invention is concerned with a stand for a beach umbrella or other object comprising a vertical pole, such as the game comprising a tubular pole carrying a tethered ball the stand comprising a container which can hold water, sand or other ballast, and having a lid, the base of the container having a formation which locates the end of the pole and the lid having an orifice vertically above the formation when the lid is in its closed position to provide a snug fit with the pole; formations being provided on the pole to coact with complemental formations in the container or on the lid to prevent rotation of the pole in the stand.

3 Claims, 5 Drawing Figures

STANDS FOR TUBULAR ARTICLES

This invention relates to stands for poles of articles such as beach umbrellas and games; for example the game comprising a vertical tubular pole carrying a spiral on its upper end, its lower end being anchored, and a ball attached to a cord which in turn is connected to the spiral by means of a ring; the ball being struck in opposite directions by two players with the object of causing the ring to travel either to the top or bottom of the spiral to win the game.

Generally such poles have a spike at their lower ends for insertion into the ground. However, there are situations where the ground is too hard for their insertion or else the sand is too loose for an adequate anchorage.

Stands are known for beach umbrellas comprising a hollow body having a central recess constituted by or adapted to hold a sleeve which in turn holds the end of the pole of the umbrella and serves as a connector or support between top and bottom of the stand. The stand is provided with an orifice so that it may be filled with water.

It is an object of the present invention to provide a stand which has improved features over the prior art stands and which is particularly adapted for the game referred to above, which requires that the pole should not be able to rotate at all.

According to the invention there is provided a rigid stand for a vertical pole comprising a container capable of holding water or other ballast, and a lid, the base of the container having a formation adapted to locate the end of the pole, the lid having a reinforced orifice vertically above the formation when the lid is in its closed position to provide a snug fit with the pole, formations being provided on the pole to coact with complemental formations in the container or on the lid to prevent rotation of the pole in the stand.

The provision of a lid permits the container to be made with sloping sides so that they are stackable and therefore take up the minimum volume during transport or storage. Another advantage of the provision of a lid is that the lid and, if necessary, parts of the container, may have reinforcing ribs. This was not possible with the prior art stands manufactured from plastic by the blow moulding process which makes the provision of a reinforced area difficult as the process generally produces articles of uniform wall thickness only.

The orifice in the lid may be reinforced by the provision of a raised or thickened rim.

The means to prevent rotation of the pole may be incorporated into the formation on the bottom of the container, preferably consisting of a shape complemental to the shape of the end of the pole. Thus the pole may be formed with ridges or flutes and the formation on the bottom is formed complementally.

The combination of the formation on the base and the orifice in the lid ensures that the tubular article is maintained in a vertical position and that wobbling is effectively avoided. The pole is held in place by gravity only and is immediately removable simply by lifting.

Alternatively or in addition to the formation on the base, clamping means may be provided on or associated with the lid, which means may be designed to prevent rotational movement.

It will be appreciated that the lid should not be permitted to rotate on the bottom portion of the container.

In use the container is filled with water, sand or the like as ballast, the lid located in position, and the pole pushed through the orifice in the lid so that the end engages in the formation on the base.

In the game referred to above there is generally a footplate attached to the pole to assist the pole being driven into the ground and this may be arranged to abut the upper surfaces of the lid and to engage with a suitable formation or formations to prevent rotation. For this purpose the footplate is, in plan, other than a complete circle and the top of the lid is provided with one or more projections adapted to abut the non-circular portion of the periphery of the footplate.

An embodiment of the invention is described below with reference to the accompanying drawing in which.

Figure 1:
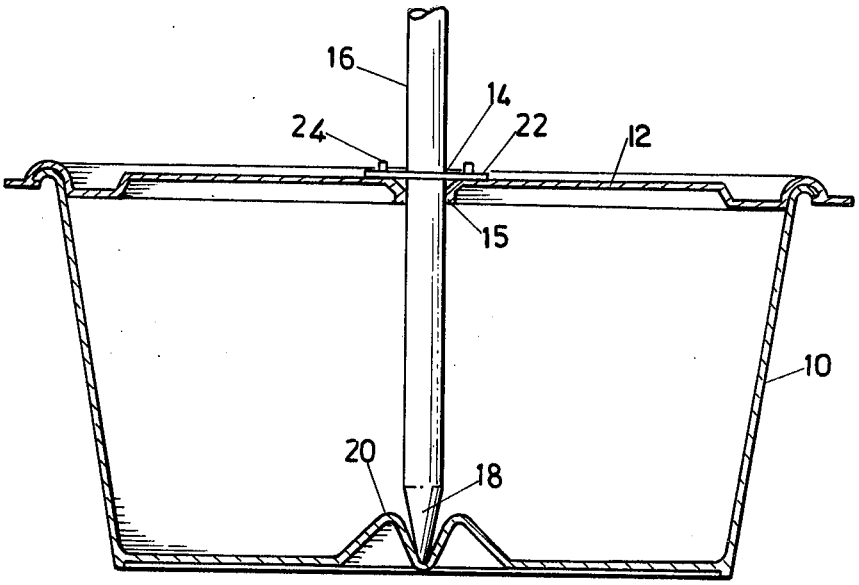
FIG. 1 is a cross-sectional side view through one form of the invention.
Figure 1A:
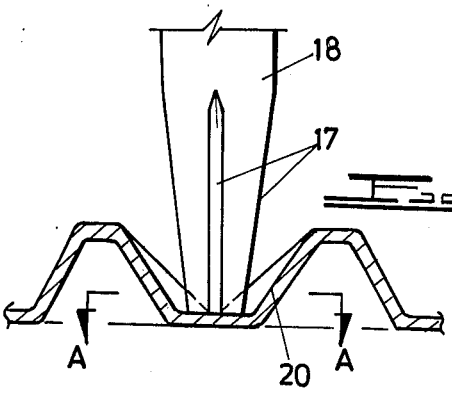
FIG. 1A is a detailed cross-sectional side view of another form of the base arrangement.
Figure 1B:
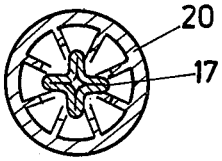
FIG. 1B is a section along the line A—A of FIG. 1A, and FIGS. 2 and 3 are alternative forms of preventing rotation of a pole.

In the drawing a container 10 is provided with a lid 12, the container having a frusto-conical shape. The lid 12 has an orifice (reinforced as shown at 15) through which a pole 16 passes snugly. The end 18 of the pole 16 may be formed with a cross or other splined arrangement 17 and engaged snugly in a complemental formation 20 on the base of the container 10, the formation 20 having a wide opening for ease of location.

The lid 12 is preferably a very tight and waterproof fit on the container so that the water used as ballast does not escape during play.

Figure 2:
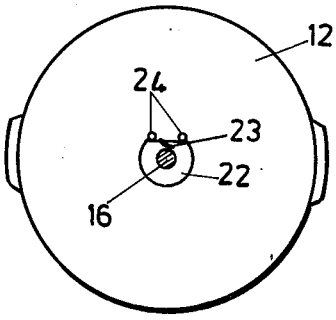

In FIG. 2 the footplate 22 of the pole of the game as described above is formed with a flat portion 23 which abuts posts 24 formed on the upper surface of the lid 12. This effectively prevents rotation of the pole should the end 18 of the pole not be provided with a splined arrangement.

Figure 3:
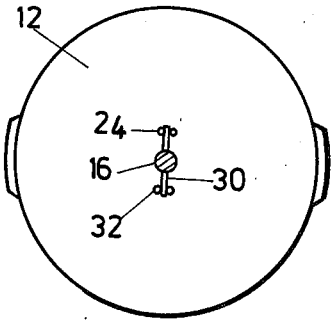

In FIG. 3 the pole 16 has transverse rod 30 which is engaged between posts 24. For additional stability a further pair of posts 32 is also provided.

An advantage of the present invention lies in the feature that the removable lid is easily snapped in and out of place so that the container can be used for general storage of large articles when not in use. Many stands occupy relatively large volumes of space and as they have no removable lid cannot be used for many other purposes when the ballast has been removed.

I claim:

1. In combination, a rigid stand and a vertical pole, the stand comprising a container capable of holding ballast, and a lid that closes the container and that has an orifice that snugly receives the pole and that is located, when the lid is in its closed position, to be above an upwardly opening female formation in the base of the container, the formation being adapted to receive and locate the lower end of the pole, and non-circular formations on the pole that coact with complemental formations on the lid to prevent rotation of the pole in the stand.

2. A stand as claimed in claim 1, said formations on the lid being adapted to coact with a transverse plate on a pole, the plate being non-circular at that zone thereof which abuts the formations.

3. A stand as claimed in claim 1, in which the formations on the lid coact with a transverse rod that extends in opposite directions from the pole, said formations on the lid being disposed on opposite sides of each end of said rod.

* * * * *